United States Patent [19]

Loos

[11] Patent Number: 4,504,996

[45] Date of Patent: Mar. 19, 1985

[54] GARBAGE DISPOSAL UTENSIL

[75] Inventor: Evelyn J. Loos, Saratoga, Calif.

[73] Assignee: Stanley M. Weir, Santa Clara, Calif.

[21] Appl. No.: 376,706

[22] Filed: May 10, 1982

[51] Int. Cl.[3] ..... A47L 25/00

[52] U.S. Cl. ..... 15/105; 15/104 R; 15/104 S; 15/236 R; 15/245; 4/295

[58] Field of Search ..... 15/104 R, 105, 236 R, 15/245; 4/287, 295; D7/181–185; 294/1 R

[56] References Cited

U.S. PATENT DOCUMENTS

| | | | |
|---|---|---|---|
| 2,709,046 | 5/1955 | Hyde | 4/295 X |
| 2,847,683 | 8/1958 | Jordan | 4/295 |
| 3,005,996 | 10/1961 | Hyde | 4/295 |
| 3,427,636 | 2/1969 | Seifert | 15/236 R X |
| 4,268,080 | 5/1981 | Lindley | 15/105 |

FOREIGN PATENT DOCUMENTS

| | | | |
|---|---|---|---|
| 155842 | 8/1956 | Sweden | 4/295 |

*Primary Examiner*—Edward L. Roberts
*Attorney, Agent, or Firm*—Stanley M. Weir

[57] ABSTRACT

An improved garbage disposal utensil for use with a garbage disposal. A circular member is provided which has a stopper lip to seal the disposal drain hole and flexible lobes on the circular member to hold the lip out of sealing relationship with the drain hole. A recessed handle is provided in a recess on the upper side of the circular member and a scraper blade is provided on the lower side of the circular member.

2 Claims, 5 Drawing Figures fig_1
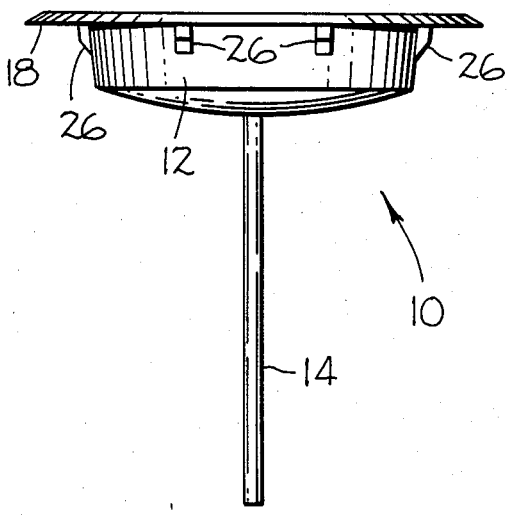
fig_2
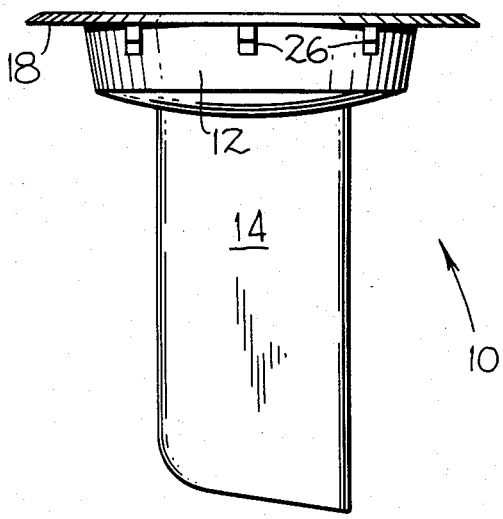
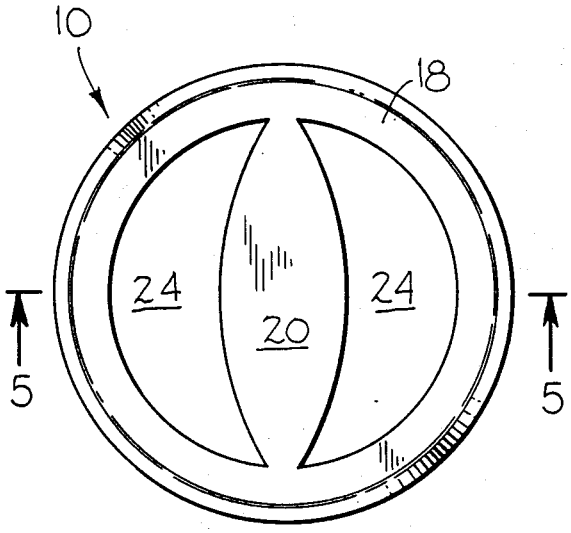
fig_3
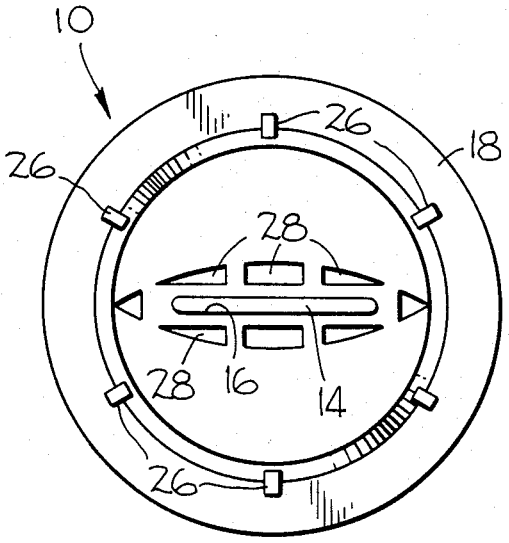
fig_4
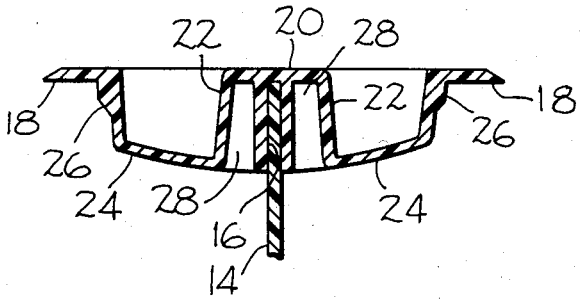
fig_5

GARBAGE DISPOSAL UTENSIL

SUMMARY OF THE PRESENT INVENTION

Subsequent to filing and patenting the multi-purpose garbage disposal utensil invention, U.S. Pat. No. 4,297,761, it was recognized that several changes would substantially improve the utility of the invention.

Objective of the improvement is to add a drain-through feature to the utensil and thereby give the user of the utensil the option of using the utensil either as a sink stopper, or as a sink drain which allows liquid and small particles to drain out of a sink, but prevents objects such as silverware placed in a sink from falling into a garbage disposer. Another advantage of this stopper drain-through option feature is that the improved garbage disposal utensil may conviently rest in a garbage diposal drain hole when not in use. This avoids the inconvience of having to remove the utensil from where it is used to a storage location, such as a kitchen drawer, and later having to retrieve it from storage when needed either as a stopper or as a drain.

It was thought that the original garbage disposal utensil would serve as a drain merely by cocking the plug part of the utensil in the drain hole. However, the plug part of the utensil frequently would not stay in the cocked position because: (1) the weight of the blade tended to right the plug into the sealing position, (2) tension of the garbage disposal splash-back flaps acting on the blade also tended to right the plug into the sealing position, and (3) when water from a faucet hit the upright part of the cocked plug, it forced the plug into the sealing position. An important object of the present improved garbage disposal utensil is to provide positive drain-through construction which takes manual action to change the utensil from its drain-through user to its stopper use.

While adding the above object improvement, the present improved garbage disposal utensil invention retains all the advantages of the original garbage disposal utensil invention. For example, its blade is equally useful in sweeping garbage into a garbage disposer and in unclogging and speeding up disposal of garbage. It retains a low-profile handgrip which does not protrude up into a sink and therefore the handgrip does not interfer with the laying of dishware and cook ware flat on the bottom of a sink.

These and other objects and advantages of the present invention will no doubt become apparent after reading the following detailed description of the preferred embodiments which are illustrated in the figures of the drawing.

IN THE DRAWING

FIG. 1 is a front elevation view of the present invention.

FIG. 2 is a side elevation view of the present invention.

FIG. 3 is a top view of the present invention.

FIG. 4 is a bottom view of the present invention.

FIG. 5 is a partial crossection view of the present invention taken along line 5—5 of FIG. 1.

DETAILED DESCRIPTION OF THE PREFERRED EMBODIMENTS

Referring now to FIGS. 1 through 5, there is shown an improved garbage disposal utensil 10 in accordance with the present invention. The disposal utensil 10 may be formed as a single piece or may be constructed of two pieces, the stopper/drain piece 12 and the blade piece 14. As best shown in FIGS. 4 and 5, the blade 14 is secured in a slot 16 in the stopper/drain piece 12. The stopper/drain piece may be made of more pliable material than the blade. Stopper lip 18 serves as the plug member of the present invention and pliability of this member aids in sealing a garbage disposer drain hole. The blade part of the present invention requires sufficient rigidity to poke and agitate garbage to urge it into a garbage disposer as well as sufficient rigidity to serve as a spatula-like blade in sweeping garbage into a drain hole.

Stopper lip 18 seals a garbage disposer drainhole around the rim of the drain hole at sink bottom level where the diameter of most garbage disposer drainhole openings are the same.

As best shown in FIG. 5, the top side of lip 18 is at the same level as the top of handgrip 20. The sides 22 of handgrip 20 extend down into the drain hole when utensil 10 is seated in a drain hole, and therefore the handgrip does not protrude above sink bottom level.

Handgrip 20 is connected to stopper lip 18 by two concave "half-moon" shaped sections 24. Protruding from sections 24 are drain lobes 26. The distance between the outer edges of lobes 26 is slightly greater than the diameter of opposed the rim opening of a garbage disposer drain hole. When the present garbage disposal utensil is placed in a garbage disposer drain hole, lobes 26 hold stopper lip 18 slightly above the rim of the garbage disposer drain hole allowing water, coffee grounds and the like to drain into the drain hole, but larger objects, such as silveware, are prevented from passing through the narrow slits formed between the underside of stopper lip 18 and a garbage disposer drain hole rim.

When the present utensil 10 is pushed down using handgrip 20, the pliable lobes 26 are compressed and slip into a drain hole, allowing stopper lip 18 to come into contact with the area around the rim of the drain hole to plug it. Blade 14 is secured in slot 16 inside handgrip 20. Ribs 28 connect the walls of slit 16 with the sides 22 of handgrip 20 to strengthen the connection of stopper/drain piece 12 with blade 14.

Advantage of the above described improvement to the original garbage disposal utensil invention 15 that it provides the ability of the utensil to serve as a drain as well as a drain hole stopper. In achieving this improvements, the location of where the plug member of the utensil seals the drain hole was changed from a position down in the drain hole to the area around the rim of the drain hole. This in turn lead to a change in the handgrip of the utensil to a position largely below the plug part of the utensil to continue to have a low profile handgrip which does not protrude very much above a drain hole opening.

It is believed apparent that the invention is not necessarily confined to the specific uses described above since it may be be utilized for any purpose to which it may be suited. Nor is the invention necessarily limited to specific construction illustrated and described, since such construction is only intended to be illustrative of the principles of operation, it being considered that the invention comprehends any variations covered by the basic principles disclosed.

What is claimed is:

1. The improvement in garbage disposal utensils of the type wherein a circular member defines an upper and lower surface which member serves as a protector and either as a plug or drain, and wherein a handle is secured to the upper surface and a blade is secured to the lower surface of said circular member and wherein said blade extends substantially through a disposal splash back protector to a distance above the disposal garbage grinding blades when the circular member is resting on the disposal splash back protector, the improvement which comprises:

A. a stopper lip formed around the periphery of said circular member adjacent to the upper surface thereof and adapted to extend outwardly to seal the area around the rim of a disposal drain hole when said lip is in contact with the area around the rim;

B. a recess in the upper surface of said circular member;

C. a handle formed in said recess and positioned substantially below said upper surface;

D. flexible lobes formed on the circular member below said lip and extending outwardly from said circular member to contact the opening in a disposal drain hole, whereby the lower extremities of said flexible lobes are adapted to rest on a disposal drain hole rim positioning said lip above the drain hole and when the circular member is pressed down, the lobes are adapted to be pressed inwardly and permit the circular member to move downwardly to move said lip into sealing engagement with said drain hole;

E. a scraper blade mounted on the lower surface of said circular member and extending downwardly therefrom so that it extends substantially through a disposal splash back protector to a distance above the disposal grinding blades when the stopper lip is sealing the area around the rim of a disposal drain hole.

2. The garbage disposal utensil of claim 1 wherein the lobes angle inward from top to bottom.

* * * * *